US009858942B2

(12) United States Patent
Wolff et al.

(10) Patent No.: US 9,858,942 B2
(45) Date of Patent: Jan. 2, 2018

(54) SINGLE CHANNEL SUPPRESSION OF IMPULSIVE INTERFERENCES IN NOISY SPEECH SIGNALS

(75) Inventors: Tobias Wolff, Ulm (DE); Christian Hofmann, Hausen (DE)

(73) Assignee: NUANCE COMMUNICATIONS, INC., Burlington, MA (US)

( * ) Notice: Subject to any disclaimer, the term of this patent is extended or adjusted under 35 U.S.C. 154(b) by 473 days.

(21) Appl. No.: 14/126,556

(22) PCT Filed: Jul. 7, 2011

(86) PCT No.: PCT/US2011/043145

§ 371 (c)(1),
(2), (4) Date: Dec. 16, 2013

(87) PCT Pub. No.: WO2013/006175

PCT Pub. Date: Jan. 10, 2013

(65) Prior Publication Data

US 2014/0095156 A1 Apr. 3, 2014

(51) Int. Cl.
*G10L 21/00* (2013.01)
*G10L 19/00* (2013.01)
(Continued)

(52) U.S. Cl.
CPC ..... *G10L 21/0208* (2013.01); *G10L 19/025* (2013.01); *H04R 2410/07* (2013.01)

(58) Field of Classification Search
CPC ..... G10L 704/50
(Continued)

(56) References Cited

U.S. PATENT DOCUMENTS 4,771,472 A * 9/1988 Williams, III ..... H03G 3/301 381/107
5,388,182 A * 2/1995 Benedetto ..... G10L 19/0212 704/200.1
(Continued)

FOREIGN PATENT DOCUMENTS

CN 1325222 A 12/2001
CN 101601088 A 12/2009
(Continued)

OTHER PUBLICATIONS

Kyoya, Naoki, and Kaoru Arakawa. "A method for impact noise reduction from speech using a stationary-nonstationary separating filter." Communications and Information Technology, 2009. ISCIT 2009. 9th International Symposium on. IEEE, 2009.*
(Continued)

*Primary Examiner* — Fariba Sirjani
(74) *Attorney, Agent, or Firm* — Daly, Crowley Mofford & Durkee, LLP

(57) ABSTRACT

Methods and apparatus for reducing impulsive interferences in a signal, without necessarily ascertaining a pitch frequency in the signal, detect onsets of the impulsive interferences by searching a spectrum of high-energy components for large temporal derivatives that are correlated along frequency and extend from a very low frequency up, possibly to about several kHz. The energies of the impulsive interferences are estimated, and these estimates are used to suppress the impulsive interferences. Optionally, techniques are employed to protect desired speech signals from being corrupted as a result of the suppression of the impulsive interferences.

19 Claims, 10 Drawing Sheets

(51) Int. Cl.
*G10L 21/0208* (2013.01)
*G10L 19/025* (2013.01)

(58) Field of Classification Search
USPC ..... 704/200–200.1, 205–210, 226–229, 704/270.1, 500–504, E19.001–E19.049
See application file for complete search history.

(56) References Cited

U.S. PATENT DOCUMENTS 5,596,676 A * 1/1997 Swaminathan ..... G10L 19/012 704/208
5,946,649 A * 8/1999 Javkin ..... G10L 21/0364 704/203
6,205,422 B1 * 3/2001 Gu ..... G10L 25/78 704/210
6,209,094 B1 * 3/2001 Levine ..... G06T 1/005 375/E7.018
6,453,282 B1 * 9/2002 Hilpert ..... H04B 1/665 704/200.1
6,711,539 B2 * 3/2004 Burnett ..... A61B 5/0507 704/223
7,822,600 B2 * 10/2010 Kim ..... G10L 25/90 704/207
7,949,522 B2 * 5/2011 Hetherington ..... G10L 21/0208 704/226
8,131,543 B1 * 3/2012 Weiss ..... G10L 25/78 704/210
9,626,974 B2 * 4/2017 Thiergart ..... G10L 19/008
2002/0035471 A1 * 3/2002 Breton ..... G10L 15/20 704/233
2002/0071573 A1 6/2002 Finn
2003/0019931 A1 * 1/2003 Tsikos ..... G02B 26/10 235/454
2004/0024588 A1 * 2/2004 Watson ..... G06T 1/0028 704/200.1
2004/0230105 A1 * 11/2004 Geva ..... A61B 5/04012 600/301
2005/0027520 A1 * 2/2005 Mattila ..... G10L 21/0208 704/228
2006/0036431 A1 * 2/2006 Den Brinker ..... G10L 19/093 704/206
2006/0098809 A1 * 5/2006 Nongpiur ..... G10L 21/0364 379/406.14
2006/0100868 A1 * 5/2006 Hetherington ..... G10L 21/0208 704/226
2006/0229869 A1 * 10/2006 Nemer ..... G10L 21/0208 704/226
2007/0011001 A1 * 1/2007 Kim ..... G10L 19/06 704/219
2007/0078649 A1 * 4/2007 Hetherington ..... G10L 21/0216 704/226
2007/0185718 A1 * 8/2007 Di Mambro ..... G06F 21/32 704/273
2007/0288233 A1 * 12/2007 Kim ..... G10L 25/93 704/208
2008/0071530 A1 * 3/2008 Ehara ..... G10L 19/005 704/223
2008/0260175 A1 * 10/2008 Elko ..... H04R 3/005 381/73.1
2009/0193895 A1 * 8/2009 Date ..... G01H 17/00 73/579
2009/0222261 A1 * 9/2009 Jung ..... G10L 19/24 704/219
2010/0020986 A1 * 1/2010 Nemer ..... H04R 3/00 381/94.1
2010/0054085 A1 * 3/2010 Wolff ..... G01S 3/8083 367/125
2010/0262420 A1 * 10/2010 Herre ..... G10L 19/20 704/201
2011/0026730 A1 * 2/2011 Li ..... H04R 3/005 381/92
2011/0164761 A1 * 7/2011 McCowan ..... H04R 3/005 381/92
2013/0022206 A1 * 1/2013 Thiergart ..... G10L 19/008 381/17
2014/0095156 A1 * 4/2014 Wolff ..... G10L 19/025 704/226
2014/0128032 A1 * 5/2014 Muthukumar ..... H01Q 3/00 455/411
2017/0134876 A1 * 5/2017 Thiergart ..... G10L 19/008

FOREIGN PATENT DOCUMENTS

EP 1 450 353 A1 8/2004
JP 6-269084 9/1994
JP 2001-124621 5/2001
JP 2004-254322 9/2004
JP 2004-254329 9/2004
JP 2006-163417 6/2006
JP 2007-114774 5/2007
JP 2010-124299 6/2010
JP 2011-248296 12/2011

OTHER PUBLICATIONS

Japanese Patent Application No. 2014-518528 Notice of Allowance dated Apr. 20, 2015 with English emailed cover letter allowed claims, 13 pages.
Japanese Patent Application No. 2014-518528 Office Action dated Jan. 20, 2015, including Foreign Associate cover letter dated Feb. 4, 2015 and English translation, 6 pages.
Yamaguchi, Ryo et al., "A study of Musical-Noise mitigation in noise reduction signal processing", Acoustical Society of Japan 2004 Spring Meeting Koen Ronbunshu—I—[translator's note: translated as collection of lecture articles I-, Mar. 2004, pp. 619-620. No translation available.
Hayashi, Hiroaki et al., "An impact Noise Suppression for Speeches Using Morphological Component Analysis", The Institute of Electronics, Information and Communication Engineers Technical Report, May 2007, vol. 107, No. 64, pp. 13-18; including English Abstract.
Hayashi, Hiroaki et al., "Impact Noise Suppression for Speech Signals by Using a Morphological Component Analysis with DFT", The Institute of Electronics, Information and Communication Engineers Technical Report, Dec. 2007, vol. 107, No. 374, pp. 47-52; including English Abstract.
Wang, Bing et al., "An improved CANNY edge detection algorithm", Proceedings of the 2nd International Workshop on Computer Science and Engineering (WCSE 2009), IEEE, Oct. 2009, pp. 497-500.
Chinese Notice of Granting Patent Right for Invention dated Sep. 10, 2015; For Chinese Pat. App. No. 201180073151.4; 4 pages.
European Patent Application No. 11 730 861.9 Office Action dated Oct. 17, 2014, 4 pages.
Notification Concerning Transmittal of International Preliminary Report on Patentability (Chapter 1 of the Patent Cooperation Treaty), PCT/US2011/043145 dated Jan. 16, 2014, 2 pages.
Written Opinion of the International Searching Authority, PCT/US2011/043145 dated Jan. 16, 2014, 5 pages.
Chinese Patent Application No. 201180073151.4, Office Action dated Apr. 3, 2015, including English translation, 10 pages.
International Search Report, PCT/US2011/043145, International filing date Jul. 7, 2011, 4 pages.
Written Opinion, PCT/US2011/043145, International filing date Jul. 7, 2011, 7 pages.
Bing Wang et al.: "An Improved CANNY Edge Detection Algorithm", Computer Science and Engineering, 2009. WCSE '09. Second International Workshop on, IEEE, Piscataway, NJ, USA. Oct. 28, 2009, pp. 497-500, XP031622568, ISBN: 978-0-7695-3881-5, p. 497, right-hand column, line 24-p. 499, left-hand column, last line; figure 1.
Response to Office Action dated Aug. 18, 2015 for Chinese Application No. 201180073151.4, 17 pages.

(56) References Cited

OTHER PUBLICATIONS

Response to Office Action dated Feb. 9, 2015 for European Application No. 11730861.9; 16 pages.
Response to Office Action dated Mar. 3, 2015 for Japanese Application No. 2014-518528; 18 pages.
Certificate of Grant dated May 29, 2015 for Japanese Application No. 2014-518528; 2 pages.

* cited by examiner

Gray scale indicates energy level
(white = 0, black = maximum)

SINGLE CHANNEL SUPPRESSION OF IMPULSIVE INTERFERENCES IN NOISY SPEECH SIGNALS

TECHNICAL FIELD

The present invention relates to signal processing and, more particularly, to suppression of impulsive interferences in noisy speech signals.

BACKGROUND ART

Impulsive interference is a process characterized by bursts of one or more short pulses whose amplitudes, durations and times of occurrences are random. Systems that process human speech signals, such as automatic speech recognition (ASR) systems, that are used in noisy environments, such as automobiles, may be subject to impulsive interferences, such as due to road bumps or wind buffets from open windows. Mobile communication devices and other microphone-based systems used in windy environments or combat zones provide other examples of systems that are subjected to impulsive interferences.

Conventional single channel noise suppression algorithms are typically able to suppress stationary, i.e., continuous, noises, such as car engine noise, because these stationary noises can be relatively easily distinguished from speech signals. However, a large class of impulsive interferences exhibits highly non-stationary characteristics, much like speech signals, and can not, therefore, be suppressed using standard single channel noise reduction algorithms. In fact, applying standard single channel noise reduction algorithms when impulsive interferences are present often reduces speech recognition performance and ease of use.

Wind noise can be particularly problematic. For example, wind noise can occur even in a quiet surrounding, such as directly within a capsule of a microphone. Thus, a user of the microphone may not even be aware of the problem and may not, therefore, compensate for the noise, such as by speaking louder. Multiple-microphone systems can, in some cases, suppress wind noise generated within one of the microphones. However, many important applications require only a single microphone and are not, therefore, susceptible to multi-microphone solutions.

Some time-domain approaches for non-stationary noise reduction exist. So-called templates or prototypes are proposed (e.g. [2], [3]) for restoring old recordings by removing transients. Vaseghi [2] proposes a method for detection that includes a matched filter for a respective template, followed by removal with an interpolator. Restoring old recordings does not, however, have to be performed in real time. Therefore, non-causal filtering can be employed in these contexts, unlike the applications contemplated above. Godsill uses a statistical approach and models signal and interference as two automatic speech recognition processes excited by two independent and identically distributed (i.i.d.) variables. In Gaussian processes [3], removal is performed by tracing the trajectory of the desired-signal component of a Kalman filter using the aforementioned models.

A more recent publication on this topic, dedicated to the removal of wind noise in particular, is [4] by King and Atlas. The proposed concept completely relies on a computationally expensive least-squares-harmonic (LSH) pitch estimate, as proposed in [5]. ("Pitch" or "pitch frequency" here means a fundamental or other single frequency component of a signal. For example, a speech signal of an uttered vowel sound contains a pitch frequency and typically several other frequencies that are harmonically related to the pitch frequency. The pitch frequency can vary between the beginning and the end of the utterance.) The mismatch of the LSH speech model, together with an energy constraint, provides evidence used for interference detection. In case of voiced speech absence, a simple high-pass at about 4 kHz is applied to cut off all wind noise. In the presence of voiced speech, the wind noise is removed by low-order comb filters applied to sub-band signals that have been demodulated to base band. Afterwards, segments of voiced speech are re-synthesized. If a sufficiently good estimate of the fundamental frequency (pitch) is available, comb filtering can effectively reduce any type of broadband noise in the gaps of the harmonic speech spectrum, including wind noise. Pitch adaptive filtering for speech enhancement is, however, a well-known means [1]. As a matter of fact, getting an accurate and robust pitch estimate from noisy speech signals is a difficult task in practice.

In 2009 Nemer and Leblanc (Broadcom Corp.) proposed detecting wind noises based on linear prediction [7]. They observed that wind may be well modeled using a low order predictor, since there is no harmonic structure to it. For speech, however, a higher predictor order is necessary. This can be used for distinguishing speech from wind noise, hence a suppression filter can be designed. See, for example, Pat. Publ. No. US 2010/0223054.

Kotta Manohar, et al., discuss a post-processing scheme to be applied to short-time spectral attenuation (STSA) speech enhancement algorithms in "Speech enhancement in non-stationary noise environments using noise properties," published by Elsevier in Speech Communication 48 (2006) 96-109.

T. A. Mahmoud, et al., describe an edge-guided morphological filter to sharpen digital images in "Edge-Detected Guided Morphological Filter for Image Sharpening," published by Hindawi Publishing Corporation in EURASIP Journal on Image and Video Processing, Volume 2008, Article ID 970353.

Petros Maragos discusses morphological filtering for image enhancement and feature detection in chapter 3.3 of a book titled "The Image and Video Processing Handbook," 2d edition, edited by A. C. Bovik, published by Elsevier Academic Press, 2005, pp. 135-156.

Hetherington, et al., propose another approach for wind buffet suppression, which is available from Wavemakers division of QNX Sofware Systems GmbH & Co. KG, a subsidiary of Research In Motion Ltd. See, for example, U.S. Pat. No. 7,895,036, U.S. Pat. No. 7,885,420, Pat. Publ. No. US 2011/0026734 and Pat. Publ. No. EP 1 450 354 B1. The core idea of their approach is a rather simple spectral model for wind. In particular, the wind model constitutes a straight line in a log-spectrum with a negative slope at low frequencies, up to the point where the spectral energy is dominated by background noise. Various similarity measures between the model and a signal frame are used to classify the input frame as wind, wind and speech or wind only. Furthermore, the model enables using the model's spectral shape for noise suppression. The generation of a long-term estimate by averaging over the model's instantaneous estimates from unvoiced frames is also proposed.

Besides the utilized linear model, the pitch-frequency-dependent ripples in the signal spectrum are first detected and then protected from being suppressed by interference reduction. A practical implementation of this mechanism detects peaks in the amplitude spectrum and measures each peak's width. Spectrally narrow and temporally slowly changing peaks indicate voiced speech, whereas spectrally broad and quickly changing ones indicate wind.

Furthermore, the harmonic relationship between the peaks along the frequency axis is measured using a discrete cosine transform (DCT) [6]. This directly translates into a cepstrum-based pitch estimation, if the DCT is applied to the logarithmic spectrum. Such pitch tracking methods have been proposed in the late 1960s.

This method is thus built on the assumed knowledge of the pitch frequency, together with a simple spectral model. Signal components that have not been found to belong to the desired signal are suppressed. The suppression is implemented by means of spectral weighting in the short-time Fourier transform domain. The wind noise suppression may, therefore, be used in conjunction with regular noise reduction.

Unfortunately, these prior art methods for reducing impulsive interferences suffer from one or more disadvantages. For example, the methods described by Hetherington require considering pitch of the speech signal in some way.

SUMMARY OF EMBODIMENTS

An embodiment of the present invention provides a method for reducing impulsive interferences in a signal. The method automatically performs several operations, including identifying high-energy components of the signal. The high-energy components are identified, such that the energy of each of the identified high-energy components exceeds a predetermined threshold. Temporal derivatives of the identified high-energy components are identified. The identified temporal derivatives are morphologically filtered. Morphologically filtering the identified temporal derivatives includes detecting onsets of the impulsive interferences and estimating interference energies in the signal. The detection and estimation are based at least in part on the identified temporal derivatives. Portions of the signal are suppressed, based on the estimated interference energies.

Identifying the high-energy components may include determining the threshold, such that the threshold is below a spectral envelope of the signal. Optionally or alternatively, the threshold may be determined based at least in part on a spectral envelope of the signal and at least in part on a power spectral density of stationary noise in the signal. Under a first condition, the threshold may be a calculated value below the spectral envelope of the signal, and under a second condition, the threshold may be a calculated value above the power spectral density of the stationary noise.

Each of the identified temporal derivatives may be associated with a frequency range. The frequency ranges associated with the identified temporal derivatives may collectively form a contiguous range of frequencies, beginning below a predetermined frequency, such as about 100 Hz or about 200 Hz. Gaps may be allowed in the contiguous range of frequencies. If so, each gap is less than a predetermined size.

Identifying the temporal derivatives may include identifying a region of proximate temporal derivatives in a spectrum of the identified high-energy components. That is, each of the temporal derivatives may be next to or near, in terms of frequency or frequency range, another of the temporal derivatives.

Identifying the plurality of temporal derivatives may include identifying temporal derivatives that exceed a predetermined value.

Morphologically filtering the identified plurality of temporal derivatives may include applying a two-dimensional image filter to the identified temporal derivatives.

The method may include binarizing the identified plurality of temporal derivatives, i.e., converting each temporal derivative to one of two binary values, such as zero and one.

Estimating the interference energies may include initially estimating the interference energies based on a power spectral density of the signal for at least a predetermined period of time and thereafter imposing a temporal monotonic decay on the estimated interference energies.

Morphologically filtering the identified temporal derivatives may include calculating values for interference bins, based at least in part on the estimated interference energies. Detecting the onsets of the impulsive interferences may include detecting the onsets of the impulsive interferences based at least in part on the calculated values for the interference bins of a previous time frame.

The method may include a post-processing operation, in which a starting frequency is determined and the estimated interference energies are automatically modified, so as to enforce a progressively smaller estimated interference energy for progressively higher frequencies, beginning at the determined starting frequency.

Optionally, a signal-to-interference ratio (SIR) and/or a total interference-to-noise ratio (INR) may be calculated. An operational parameter that influences how the estimated interference energies are modified may be adjusted, based the calculated SIR and/or INR.

The method may include automatically calculating a signal-to-interference ratio (SIR) and/or a total interference-to-noise ratio (INR). The starting frequency may be adjusted, based on the calculated SIR and/or INR.

Another embodiment of the present invention provides a filter for reducing impulsive interferences in a signal. The filter includes a high-energy component identifier, a temporal differentiator coupled to the component identifier, a morphological filter coupled to the temporal differentiator and a noise reduction filter coupled to the morphological filter. The high-energy component identifier is configured to identify high-energy components of the signal, such that the energy of each of the identified high-energy component exceeds a predetermined threshold. The temporal differentiator is configured to identify temporal derivatives of the identified high-energy components. The morphological filter is configured to detect onsets of the impulsive interferences and estimate interference energies in the signal, based at least in part on the identified temporal derivatives. The noise reduction filter is configured to suppress portions of the signal, based on the estimated interference energies.

The predetermined threshold may be below a spectral envelope of the signal. Optionally or alternatively, the predetermined threshold may be based at least in part on a spectral envelope of the signal and at least in part on a power spectral density of stationary noise in the signal. Under a first condition, the threshold may be a calculated value below the spectral envelope of the signal, and under a second condition, the threshold may be a calculated value above the power spectral density of the stationary noise.

Each of the identified temporal derivatives may be associated with a frequency range. The frequency ranges associated with the identified temporal derivatives may collectively form a contiguous range of frequencies beginning below a predetermined frequency, such as about 100 Hz or about 200 Hz. The contiguous range of frequencies may include at least one gap of less than a predetermined size. The temporal differentiator may be configured to identify the temporal derivatives by identifying a region of proximate temporal derivatives in a spectrum of the identified high-energy components. That is, each of the temporal derivatives may be next to or near, in terms of frequency or frequency range, another of the temporal derivatives.

The temporal differentiator may be configured to identify the temporal derivatives, such that each of the identified temporal derivatives exceeds a predetermined value.

The morphological filter may be configured to apply a two-dimensional image filter to the identified temporal derivatives.

The morphological filter may be configured to binarize the identified temporal derivatives, i.e., to convert each temporal derivative to one of two binary values, such as zero and one.

The morphological filter may be configured to estimate the interference energies by initially estimating the interference energies based on a power spectral density of the signal for at least a predetermined period of time and thereafter imposing a temporal monotonic decay on the estimated interference energies.

The morphological filter may be configured to calculate values for interference bins, based at least in part on the estimated interference energies. The morphological filter may be configured to detect onsets based at least in part on the calculated values for the interference bins of a previous time frame.

Optionally, the filter may include a post-processor configured to automatically determine a starting frequency and modify the estimated interference energies, so as to enforce a progressively smaller estimated interference energy for progressively higher frequencies, beginning at the determined starting frequency.

Optionally, the filter may include a post-processor controller coupled to the post-processor. The post-processor controller may be configured to automatically calculate a signal-to-interference ratio (SIR) and/or a total interference-to-noise ratio (INR). The post-processor controller may be further configured to automatically adjust an operational parameter that influences how the post-processor modifies the plurality of estimated interference energies. The post-processor controller may be further configured to automatically adjust the starting frequency. In either case, the automatic adjustment may be based on the calculated SIR and/or INR.

Yet another embodiment of the present invention provides a computer program product for reducing impulsive interferences in a signal. The computer program product includes a non-transitory computer-readable medium. Computer readable program code is stored on the computer-readable medium. The computer readable program code includes program code for identifying high-energy components of the signal. The energy of each identified high-energy component exceeds a predetermined threshold. The computer readable program code also includes program code for identifying temporal derivatives of the identified high-energy components. The computer readable program code also includes program code for morphologically filtering the identified temporal derivatives, including detecting onsets of the impulsive interferences and estimating interference energies in the signal, based at least in part on the identified temporal derivatives. The computer readable program code also includes program code for suppressing portions of the signal, based on the estimated interference energies.

Other embodiments of the present invention provide methods and apparatus for calculating a total interference-to-noise ratio (INR) and detecting an interference, based at least in part on the calculated INR. Yet other embodiments of the present invention provide methods and apparatus for calculating a signal-to-interference ratio (SIR) and detecting speech, based at least in part on the calculated SIR.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

In accordance with preferred embodiments of the present invention, methods and apparatus are disclosed for reducing impulsive interferences in a signal, without necessarily ascertaining a pitch frequency in the signal. We estimate energy of the impulsive interferences and then suppress the impulsive interferences by reducing the energies of frequencies in the signal that were found to have been contributed by the impulsive interferences. Optionally, we employ techniques to protect desired speech signals from being corrupted as a result of the suppression of the impulsive interferences, i.e., we reduce the extent to which speech signals are mistaken for impulsive interferences or otherwise inadvertently degraded.

Overview

Figure 1:
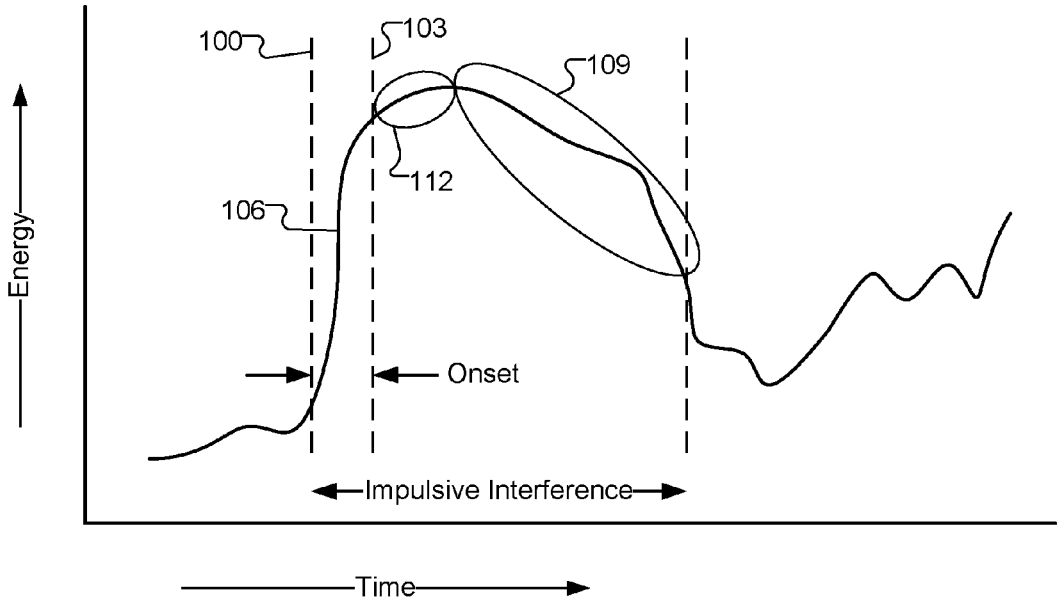
FIG. 1 illustrates an onset of a hypothetical impulsive interference in a hypothetical signal.

Signals, such as speech signals, consist of frequency components. Each frequency component has an energy level. Over time, such as during the course of an utterance of a word or a phoneme, the frequencies found in the signal and the energy levels of each frequency component can vary. We have discovered that the beginnings of many impulsive interferences are characterized by large, sudden changes in the energies of a certain set of frequency components (referred to herein as a set of frequency components or a set of frequencies). We refer to changes over time as "temporal derivatives," and we refer to the beginnings of these large, sudden changes in energies as "onsets." FIG. 1 is an energy-time graph for a single frequency bin that illustrates a hypothetical onset, delimited between dashed lines 100 and 103, of an impulsive interference in a hypothetical signal 106. Note that the onset may be much shorter than the impulsive interference. Telltale sets of frequency components in interference onsets are characterized by relatively high energy levels and contiguous or nearly contiguous frequencies (collectively referred to herein as contiguous frequencies, proximate frequencies, connected frequencies or connected regions) extending from very low frequencies up, possibly to about several kHz. Thus, we say many impulsive interferences can be detected by searching a spectrum of high-energy components for large temporal derivatives that are correlated along frequency and extend from a very low frequency up, possibly to about several kHz.

Figure 2:
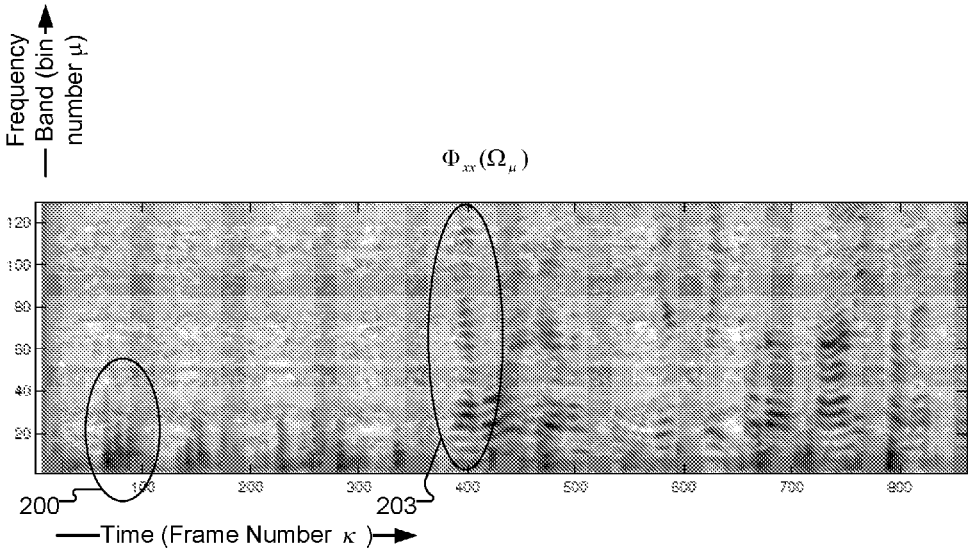
FIG. 2 is an actual spectrogram of a speech signal with occasional wind buffets.
Figure 3:
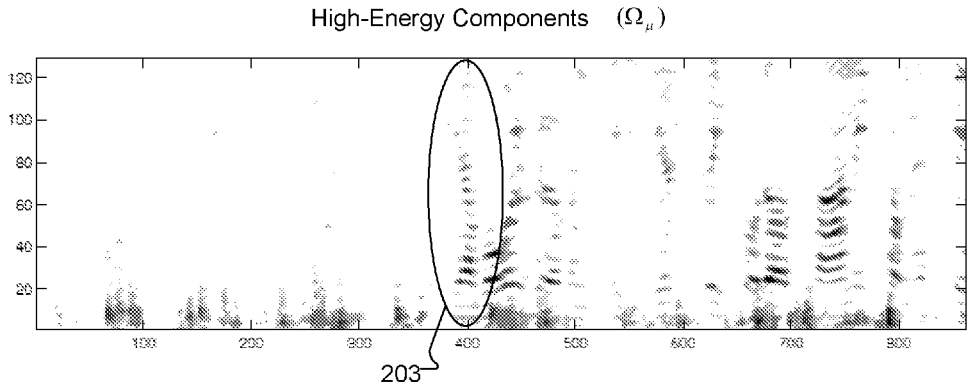
FIG. 3 is an actual result of identifying high-energy components within the spectrogram of FIG. 2, according to an embodiment of the present invention.
Figure 4:
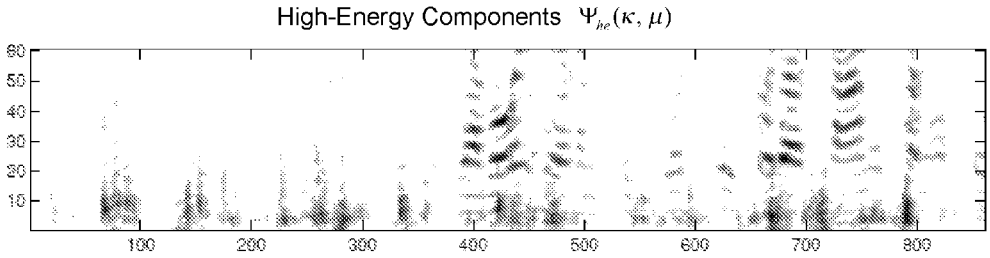
FIG. 4 is a subset of the result shown in FIG. 3.
Figure 5:
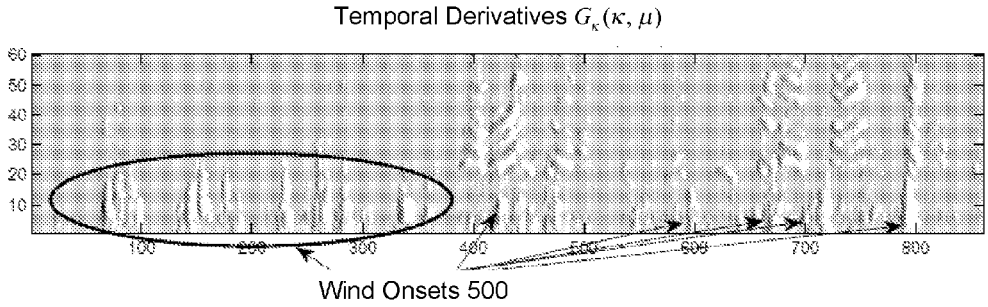
FIG. 5 depicts temporal derivatives of the signal of FIG. 4, according to an embodiment of the present invention.

FIG. 2 is an actual spectrogram of a speech signal with occasional wind buffets. The x axis represents time expressed as a time frame index (in FIG. 2, each time frame index represents about 11.6 mSec., although other values may be used), and the y axis represents arbitrarily numbered frequency bands (bins). Shades of gray represent energy levels, with white representing no energy and black representing maximum energy. An exemplary wind buffet 200 and exemplary speech 203 are outlined, although the data represented in FIG. 2 includes other wind buffets and other speech. Note that the wind buffet 200 contains a contiguous or nearly contiguous set of frequencies, whereas the speech 203 contains several harmonically related frequency components separated by spaces. FIG. 3 depicts high-energy components of the signal of FIG. 2. FIG. 4 contains a subset (only frequency bins 0 to 60 in the y axis) of the data represented in FIG. 3. FIG. 5 depicts temporal derivatives of the signal of FIG. 3. Shades of gray in FIG. 5 represent derivative values, with medium gray representing zero, black representing a large positive value and white representing a large negative value. The x axis is the same in FIGS. 2-5. Wind onsets are identified by the circled vertical connected regions 500.

As noted, an impulsive interference tends to include a set of contiguous or nearly contiguous frequencies. In contrast, a speech signal tends to include a pitch frequency plus several other frequencies that are harmonically related to the pitch frequency, with no, or relatively low levels of, energy at frequencies between the harmonically related frequencies. For example, a set of harmonically related frequencies is evident in the exemplary speech 203 shown in FIGS. 2 and 3. Thus, if one were to calculate changes in energy levels of a speech signal over frequency, rather than over time, one would find several large changes ("frequency derivatives") over the range of frequencies typically found in a speech signal. Our methods and apparatus tend not to mistake speech signals for impulsive interferences, because speech signals tend not to meet our requirement for a contiguous or nearly contiguous set of frequencies. As noted, our methods and apparatus do not require ascertaining a pitch frequency in the signal.

Figure 7:
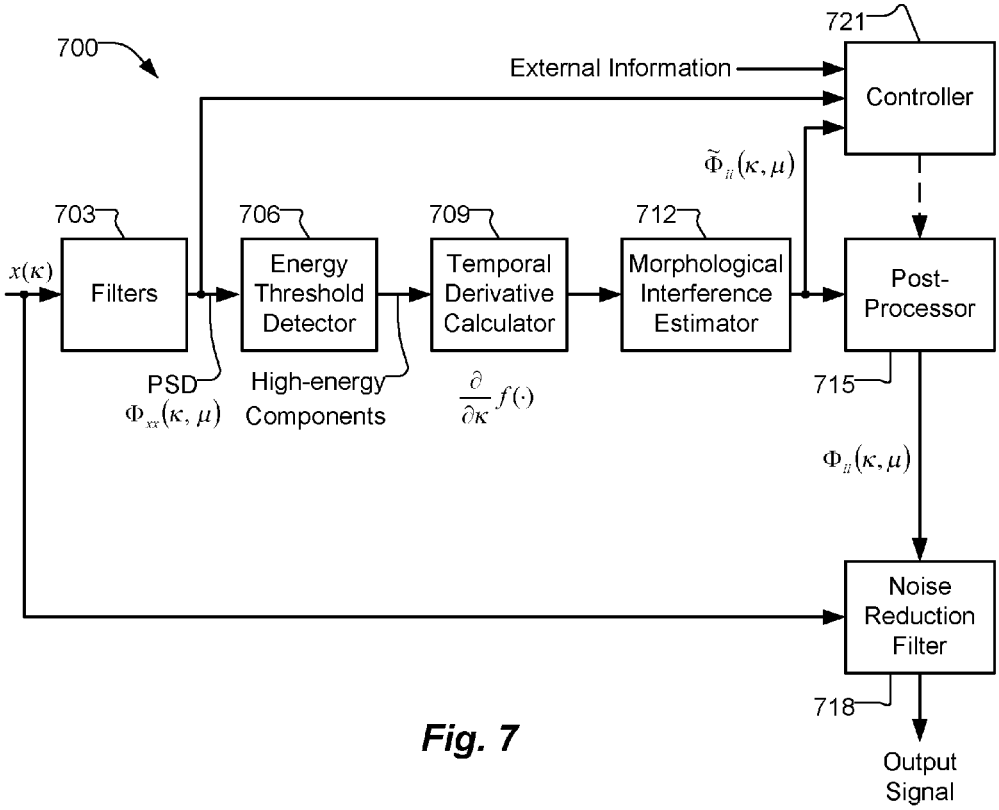
FIG. 7 is an overview schematic block diagram of a system for reducing impulsive interferences in a signal, according to an embodiment of the present invention.

FIG. 7 is an overview schematic block diagram of an embodiment 700 of the present invention that illustrates some of the general principles described herein. An input signal $x(\kappa)$ consists of a series of samples taken at regular time intervals ("time frames"), where "$\kappa$" is a time frame index. Each sample of the input signal $x(\kappa)$ is divided into frequency bands to produce a power spectral density (PSD). That is, at each time frame k, the input signal $x(\kappa)$ contains an amount of energy in each frequency band. The PSD is represented by $\Phi_{xx}(\kappa, \mu)$, where $\Phi_{xx}$ denotes an amount of energy, $\kappa$ denotes a discrete time frame index and $\mu$ denotes a discrete frequency band ("bin"). Although the embodiment shown in FIG. 7 includes a set of filters 703 to produce the PSD, any suitable mechanism or method for estimating PSD would be acceptable. Some such mechanisms and methods use filter banks and others do not. The energy level may be represented by a logarithm of the actual energy level. Thus, the PSD may be referred to as a log-spectrum.

An energy threshold detector 706 identifies high-energy components, i.e., frequency bands (bins) whose energies exceed a threshold. A temporal derivative calculator 709 identifies regions in the spectrogram where energy rises rapidly. A morphological interference estimator 712 ascertains if a contiguous or nearly contiguous set of frequencies or frequency bands, extending from a very low frequency up, possibly to about several kHz, all experience rapidly rising energies. If so, the beginning (in time) of the rapidly rising energies is deemed to be an onset of an impulsive interference, such as a wind buffet. The morphological interference estimator 712 estimates the amount of energy in each of the frequency bands (bins) for the duration of the impulsive interference. The estimated amount of energy in the impulsive interference is represented by $\tilde{\varphi}_{ii}(\kappa, \mu)$.

In some embodiments, the morphological interference estimator 712 treats the output of the temporal derivative calculator 709 as a two-dimensional image, with time index ($\kappa$) representing one dimension, and frequency band (bin) ($\mu$) representing the other dimension of the image. The morphological interference estimator 712 may then use image processing techniques to identify connected regions in the temporal derivative "image" that have the above-described frequency characteristics (extending from a very low frequency up, possibly to about several kHz, with few or no gaps) as impulsive interferences.

Once the interference energies have been estimated, the estimates may be used in a spectral weighting framework to suppress the interferences and, thereby, enhance speech. That is, the estimated energies may be subtracted from the signal to yield an impulsive interference-suppressed ("enhanced") signal. However, we prefer to take additional measures to protect the speech signal from being distorted. We, therefore, prefer to include a post-processor 715. The post processor 715 modifies the impulsive interference energy estimates, and the modified estimates, represented by $\Phi_{ii}(\kappa, \mu)$, are fed to a noise reduction filter 718. The noise reduction filter 718 subtracts the modified estimates from the input signal $x(\kappa)$ to produce an enhanced signal. Optionally, the post-processor 715 may be controlled by a controller 721, based on external information, such as information about the presence of speech, wind and/or other signal or interference information. In any case, post-processing is optional.

Figure 8:
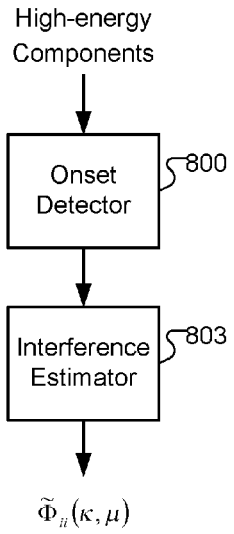
FIG. 8 is a schematic block diagram of serial onset detection and interference estimation within a morphological interference estimator of FIG. 7, according to an embodiment of the present invention.
Figure 9:
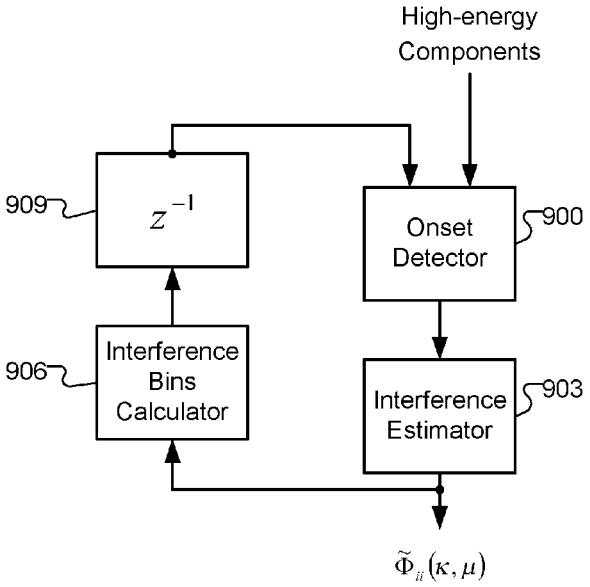
FIG. 9 is a schematic block diagram of a feedback loop within a morphological interference estimator of FIG. 7, according to another embodiment of the present invention.

As schematically illustrated in FIG. 8, onset detection 800 and interference estimation 803 for a given time frame may be performed serially, as described above. However, we prefer to include a feedback loop in the morphological interference estimator, as depicted in FIG. 9. In addition to onset detection 900 and interference estimation 903, in the feedback loop, "interference bins" are determined 906 and are stored 909 and then used during onset detection 900 during the following time frame, as discussed in more detail below.

High-Energy Component Detection

We focus on high-energy components, because we want to find onsets that constitute connected regions in the time-frequency image that result from impulsive interferences, and we do not want speech to be mistaken for such an onset. When there is a high SNR, some speech onsets, such as during voiced sounds, might appear to include connected regions, and these apparent connected regions might be mistaken for onsets of impulsive interferences. Speech onsets might appear to include connected regions, because analysis filter banks, such as the filter 703 in FIG. 7, that are commonly used usually exhibit some aliasing of components from neighboring frequency bands due to the finite selectivity of their band-pass filters. Thus, energy may leak into the gaps between the harmonically related frequencies of speech, thereby making the speech appear to include connected regions.

Speech may include high-energy components. However, the spaces between harmonically related components of speech contain little energy, as evident in the exemplary speech 203 shown in FIG. 2. Consequently, when only high-energy components are considered, the spaces between the harmonically related speech components contrast more strongly with the harmonic components and prevent the harmonic components from being identified as a contiguous set of frequencies. Thus, by focusing on high-energy components, we generally avoid being confused by speech.

On the other hand, wind buffets and other impulsive interferences tend to include contiguous sets of frequencies and are not, therefore, excluded. Consequently, we prefer to identify onsets of impulsive interferences by first identifying high-energy components in the input signal.

A fundamental quantity $\Psi_{he}(\kappa, \mu)$ used in embodiments of the present invention is a logarithmic spectrum that includes signal components with relatively high energies. Here, $\kappa$ denotes a discrete index of the time frame, and $\mu$ is the spectral subband-index. "High-energy" in this context means that the PSD of the input signal $\Phi_{xx}(\kappa, \mu)$ exceeds a threshold T. In one embodiment, the threshold is set to a value, such as about 20 dB, below the spectral envelope $H_{env}(\kappa, \mu)$ of the input signal. The spectral envelope can, of course, vary over time, but this variation is slow, relative to lengths of impulsive interferences. Other thresholds, or more complex thresholds, may be used, as described below. According to some embodiments, the logarithmic spectrum is calculated according to equation (1).

$$\Psi_{he}(\kappa, \mu) = \max\left[\log\left(\frac{\Phi_{xx}(\kappa, \mu)}{\max[T \cdot H_{env}(\kappa, \mu), \beta \cdot \Phi_{nn}(\kappa, \mu)]}\right), 0\right] \tag{1}$$

Here, $\Phi_{nn}(\kappa, \mu)$ denotes the PSD of stationary noise, and $\beta$ is an overestimation factor. If there is a high signal to noise power ratio (SNR), then $\Psi_{he}(\kappa, \mu)$ does not depend on $\Phi_{nn}(\kappa, \mu)$, because the stationary noise component is relatively small, so the term $\max[T \cdot H_{env}(\kappa, \mu), \beta \cdot \Phi_{nn}(\kappa, \mu)]$ returns $T \cdot H_{env}(\kappa, \mu)$. Only large peaks in $\Phi_{xx}(\kappa, \mu)$ exceed $T \cdot H_{env}(\kappa, \mu)$, thus the log term exceeds zero only for these large peaks. In low SNR situations, i.e., when the stationary noise is relatively high, the term max $[T \cdot H_{env}(\kappa, \mu), \beta \cdot \Phi_{nn}(\kappa, \mu)]$ returns) $\beta \cdot \Phi_{nn}(\kappa, \mu)$, so $\Psi_{he}(\kappa, \mu)$ contains signal components that exceed the noise PSD $\Phi_{he}(\kappa, \mu)$ by the factor $\beta$. During stationary noise, equation (1) should return zero for $\Psi_{he}(\kappa, \mu)$.

Temporal and Spectral Derivatives

As noted, temporal derivatives of the high-energy components are computed to identify onsets. In principle, one may also compute derivatives along the frequency axis. This is not, however, necessary for the methods and apparatus disclosed herein. Nevertheless, it may be instructive to consider how wind buffets appear after computing a spectral derivative. Any of several operators may be employed to compute derivatives. For example, Sobel, Canny and Prewitt are well-known operators used in image processing. Other operators may also be used. An operator may be defined by its filter kernel D. A filtered image is obtained by discrete 2D-convolution according to equations (2) and (3).

$$G_k(\kappa,\mu) = \Psi_{he}(\kappa,\mu) * D_\kappa \tag{2}$$

$$G_k(\kappa,\mu) = \Psi_{he}(\kappa,\mu) * D_\mu \tag{3}$$

For the Sobel operator, the filter kernels for temporal derivatives ($D_\kappa$) and spectral derivatives ($D_\mu$) are given in equation (4).

$$D_\kappa = \begin{pmatrix} 1 & 0 & -1 \\ 2 & 0 & -2 \\ 1 & 0 & -1 \end{pmatrix} \tag{4}$$

and $$D_\mu = \begin{pmatrix} 1 & 0 & -1 \\ 2 & 0 & -2 \\ 1 & 0 & -1 \end{pmatrix}$$

Figure 6:
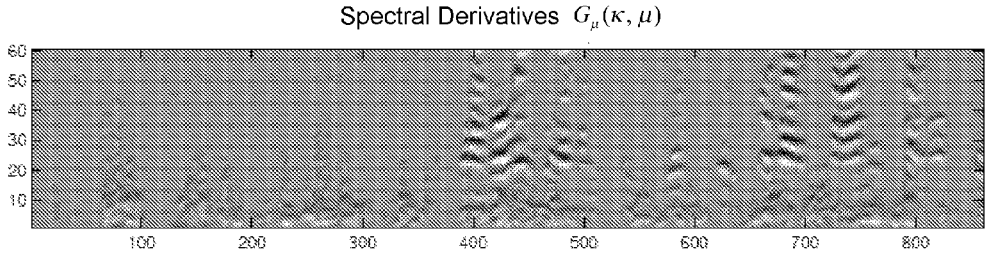
FIG. 6 depicts spectral derivatives of the signal of FIG. 4.

These kernels introduce one frame delay, but produce good results. Other kernels that use only the current time frame, together with past values, may provide low-latency algorithms. Use of such kernels may, however, degrade performance of the resulting system. As noted, FIG. 4 contains a subset (only frequency bins 0 to 60) of the data represented in FIG. 3. FIG. 5 depicts temporal derivatives of the signal of FIG. 4, generated using the Sobel operator, and FIG. 6 depicts spectral derivatives of the signal of FIG. 4, also generated using the Sobel operator. As noted, the spectral derivatives need not be calculated for the disclosed method and apparatus.

Morphological Interference Estimation

Collectively, we refer to onset detection and interference estimation as morphological interference estimation. As noted, onset detection and interference estimation may be performed serially, as discussed with respect to FIG. 8 and, optionally, a feedback loop may be employed between these operations, as discussed with respect to FIG. 9.

Onset Detection

Onset detection may involve several stages. We prefer to begin by applying a threshold function to the temporal derivatives $G_\kappa(\kappa, \mu)$ of the high-energy components. The threshold function yields a binary image $G_{bin}(\kappa, \mu)$ defined by equation (5).

$$G_{bin}(\kappa, \mu) = \begin{cases} 1 & G_\kappa(\kappa, \mu) > T_{bin} \\ 0 & G_\kappa(\kappa, \mu) \leq T_{bin} \end{cases} \tag{5}$$

Figure 10:
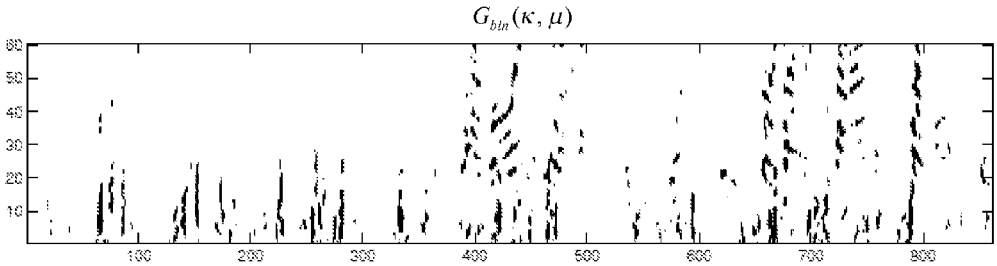
FIG. 10 depicts onsets detected after the temporal derivatives of FIG. 5 have been thresholded, according to an embodiment of the present invention.

Ones in this binary image indicate portions of the temporal derivatives that have gradients greater than $T_{bin}$, and zeros indicate portions that less than or equal to the threshold. We have found that a $T_{bin}$ of about 1 dB is sufficient. Significantly higher values may cause some of the interferences to be missed. FIG. 10 illustrates results of applying the threshold function to the temporal derivatives of FIG. 5. The binary image $G_{bin}(\kappa, \mu)$ contains only ones and zeros. In the image in FIG. 10, black represents one, and white represents zero.

Morphological filtering may then be used to extract connected regions, which we consider impulsive interferences. For instance, classical morphological operations, such as dilate, erode, open and close, may be employed to enhance, i.e., essentially find edges in and/or increase contrast of, the desired structures (connected regions) in the binary image.

We prefer to apply a recursive morphological filter, such as the filter defined by equation (6), to the binary image $G_{bin}(\kappa, \mu)$, which was calculated above.

$$G_{on}(\kappa, \mu) = \begin{cases} 1 & \text{if} \quad \begin{array}{c} 2 \cdot G_{bin}(\kappa, \mu) + G_{bin}(\kappa - 1, \mu) + \\ G_{bin}(\kappa, \mu + 1) + G_{on}(\kappa, \mu - 1) > T_{morph} \end{array} \\ 0 & \text{else.} \end{cases} \tag{6}$$

The kernel of this filter is defined by equation (7).

$$M = \begin{pmatrix} 1 & 0 \\ 2 & 1 \\ 1 & 0 \end{pmatrix} \tag{7}$$

Figure 12:
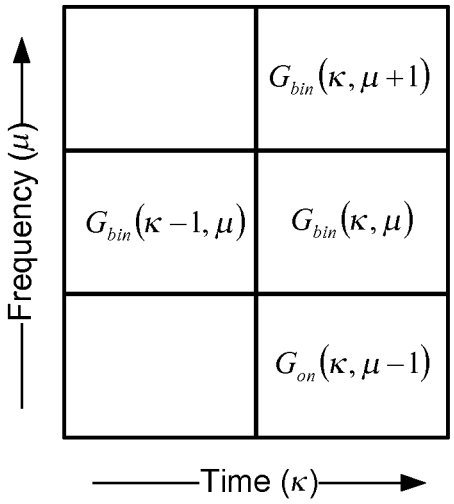
FIG. 12 is a schematic block diagram of neighbor cells (pixels), as used for recursive morphological filtration, according to an embodiment of the present invention.

The recursive morphological filter takes into account not only the current binary image cell (pixel) $G_{bin}(\kappa, \mu)$, but it also takes into account neighbor cells, where neighbors may be displaced from the current cell in the frequency ($\mu$) and/or time ($\kappa$) directions, as illustrated in FIG. 12. Compare cell contents in FIG. 12 with the terms in equation (6).

We have found that $T_{morph}=2$ provides good results, however other values may be used. With the kernel of equation (7) and $T_{morph}=2$, in order for the morphological filter to detect an onset at a given bin $G_{bin}(\kappa, \mu)$, that bin and at least one of its neighbors must be equal to one, or the bin can be zero but all three of its neighbors must be equal to one. The kernel may also be chosen differently to modify the behavior.

The filtering defined by equation (6) may be activated and deactivated, such as according to criteria shown in Table 1.

TABLE 1

| Morphological Filter Activation/Deactivation Criteria |
|---|
| 1. Start filtering if the smallest subband index of the non-zero values in $G_{bin}$ within a frame is below a predefined threshold, such as an index that represents 100 Hz or 200 Hz. This ensures that impulsive interferences begin at low frequencies. |
| 2. Start filtering if $G_{bin}(\kappa, \mu)$ and $G_{bin}(\kappa - 1, \mu)$ are both equal to 1. Consequently, the connected onset area may grow in the temporal direction, even if the lowest non-zero bin is above the predefined threshold, and the onset area is connected to a low frequency region via a past onset. |
| 3. Stop filtering if the filtering operation in equation (6) yields a zero, in which case all frequency bins above this point are set to zero. This suppresses most of the onsets that stem from speech. |

Figure 11:
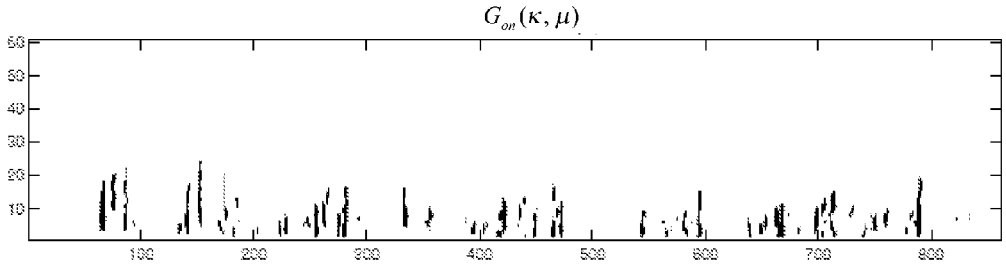
FIG. 11 depicts the onsets of FIG. 10 after morphological filtering, according to an embodiment of the present invention.

FIG. 11 depicts the onsets of FIG. 10 after morphological filtering.

Interference Estimation

As noted, an estimate of the energy of the impulsive interferences is needed so the respective signal components can be suppressed using an appropriate filtering means. Once the onsets of the interferences have been determined, the interference energy is estimated, based on the onset detection described above. Essentially, the onsets are used to trigger the interference energy estimation process. The interference energy PSD is estimated for each time frame.

At the beginning of an impulsive interference, the spectral energy in the input signal typically increases rapidly, at least for a relatively short period of time, until the signal energy of the interference plateaus for a short time or immediately begins to decrease. Note that impulsive interferences are relatively short lived, so the signal energy attributable to the interference will begin to decrease shortly after onset of the interference, such as in the portion 109 of the hypothetical signal 106 shown in FIG. 1. Once an onset has been detected, while the signal energy is increasing, such as during the portion 112, we assume the entire input signal is a result of the impulsive interference, and we generate the interference energy estimate to be equal to the entire spectral energy of the input signal. However, once the onset has passed and the input signal energy is no longer increasing, such as during the portion 112, we assume any decrease in the input signal energy is attributable to a decrease in the impulsive interference, and we decrease the estimated interference energy accordingly.

To allow for the possibility that the input signal includes speech that would otherwise be removed along with removal of the interference energy, once the input signal energy is no longer increasing, we impose a monotonic decay on the estimated interference energy, and we prevent the estimate from increasing again until the estimate has been completely decayed, i.e., until the estimate has been reduced to a predetermined or calculated value, such as zero or the then-current stationary noise level.

Thus, for the duration of an onset, we estimate the interference energy $\tilde{\Phi}_{ii}(\kappa, \mu)$ as being equal to the input signal PSD $\Phi_{xx}(\kappa, \mu)$. After the onset has passed, we keep track of the input signal PSD $\Phi_{xx}(\kappa, \mu)$ for several, preferably two, time frames. During this time, the estimated interference energy remains equal to the input signal PSD. If a Sobel operator is employed, using at least two frames for tracking is reasonable, because the Sobel kernel measures the derivative across two frames. After the tracking period, the energy estimate $\tilde{\Phi}_{ii}(\kappa, \mu)$ is only allowed to decrease, and it is not allowed to increase again until it is fully decayed. The decaying may be implemented according to equation (8).

$$\tilde{\Phi}_{ii}(\kappa,\mu)=\max(\min(\alpha_t\cdot\tilde{\Phi}_{ii}(\kappa-1,\mu)\Phi_{xx}(\kappa,\mu)),\Phi_{nn}(\kappa,\mu)) \tag{8}$$

Here, $\alpha_t$ is a positive constant, smaller than 1, used to control the rate of decay. The max operator prevents $\tilde{\Phi}(\kappa, \mu)$ from falling below the stationary noise PSD $\tilde{\Phi}_{nn}(\kappa, \mu)$.

Recursive Morphological Interference Estimation

The two operations described above (onset detection and interference estimation) may be performed sequentially as separate operations (as discussed with respect to FIG. 8) or, as noted, they may be interconnected with a feedback loop (as discussed with respect to FIG. 9). In cases where such a feedback loop is used, calculations for a given time frame may use data from one or more previous time frames, thereby introducing an element of recursion. We have found that such recursion can significantly improve onset detection and interference estimation. For example, we believe a time frame is more likely to include an interference if an immediately previous time frame included an interference. In particular, we found it useful to compute what we call "interference bins" inside the feedback loop, as described below.

Impulsive interferences last for short, but finite, amounts of time. Therefore, a single interference may span, and therefore be detected during, several contiguous time frames. In a time-frequency plane made up of bins, an interference bin is a bin, for which interference may be assumed to exist up to the time frame of the interference bin. Interference bins are represented by a binary mask of the form $W_i(\kappa, \mu)$, and values of this mask are determined in a recursive procedure. That is, the value of an interference bin of one time frame depends on at least one interference bin in a past time frame, such as $W_i(\kappa-1, \mu)$. According to one embodiment, an interference bin may be calculated according to equation (9).

$$W_i(\kappa, \mu) = \begin{cases} 1 & \text{if} \quad \begin{array}{c}(W_1(\kappa-1, \mu) + G_{on}(\kappa, \mu) > 0)\ \& \\ ((\Psi_{he}(\kappa+1, \mu) > 0)\ |\ (\Phi_{ii}(\kappa, \mu) > \Phi_{nn}(\kappa, \mu)))\end{array} \\ 0 & \text{else} \end{cases} \tag{9}$$

Thus, an interference bin may be calculated by taking into account one or more of the following: an interference estimate (at least to the extent the estimate has been calculated thus far in a current time frame), information about high-energy components, a current onset and an extent to which an interference estimate exceeds the background noise. Of course, other factors may be included in the interference bin calculation; however, we have found equation (9) to provide good results.

A relatively small gap in the frequency direction of a connected onset region may occur, even within an interference. Such a gap may be filled, as long as it is small enough, i.e., smaller than a predetermined size (limit). However, if the gap size exceeds the size limit, all interference bins above the gap, i.e., at higher frequencies than the gap, should be set to zero, because it can be assumed that the bins above a large gap do not belong to the interference and that the bins above the large gap arose due to signal components other than the currently detected interference. One way to fill a gap is by setting $W_i(\kappa, \mu)=1$.

As noted, recursion uses information from a previous time frame to calculate a value for a current time frame. According to one embodiment, recursion can be implemented in the morphological interference estimator by modifying equation (6). Replacing $G_{bin}(\kappa-1, \mu)$ in equation (6) by an interference bin $W_i(\kappa-1, \mu)$ yields equation (10).

$$G_{on}(\kappa, \mu) = \begin{cases} 1 & \text{if} \quad \begin{array}{c}2\cdot G_{bin}(\kappa, \mu) + W_i(\kappa-1, \mu) + \\ G_{bin}(\kappa, \mu+1) + G_{on}(\kappa, \mu-1) > T_{morph}\end{array} \\ 0 & \text{else.} \end{cases} \tag{10}$$

Figure 13:
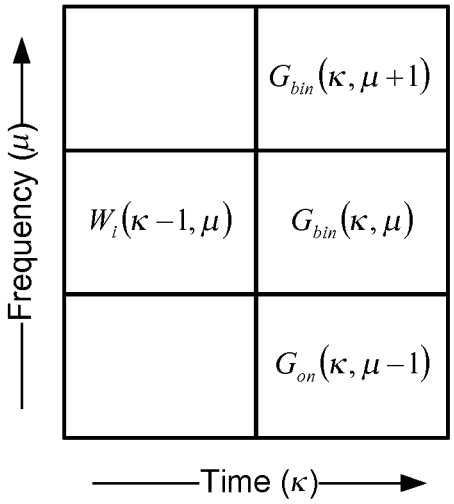
FIG. 13 is a schematic block diagram of neighbor cells (pixels), as used for recursive interference energy estimation, according to an embodiment of the present invention.

The terms of the filter defined by equation (10) include the current binary image cell (pixel) $G_{bin}(\kappa, \mu)$ and neighbor cells, where neighbors may be displaced from the current cell in the frequency ($\mu$) and/or time ($\kappa$) directions, as illustrated in FIG. 13.

Figure 14:
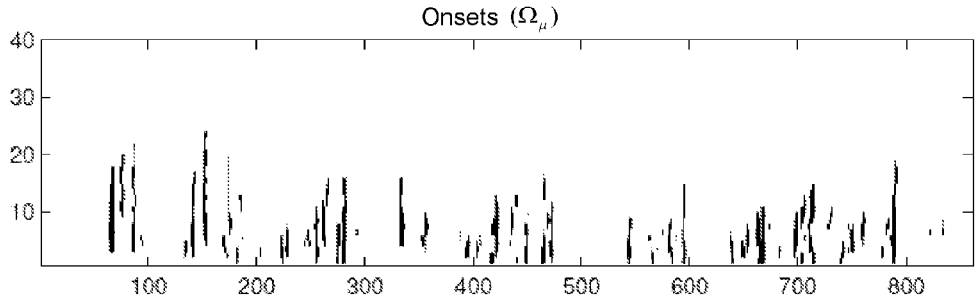
FIG. 14 illustrates onsets after morphological filtering of the temporal derivatives of FIG. 5.
Figure 15:
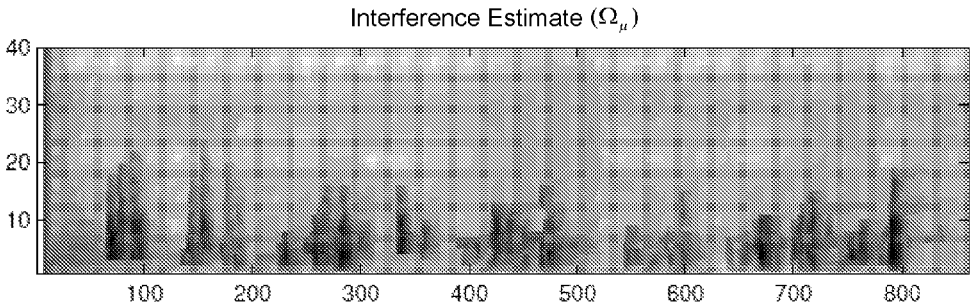
FIG. 15 illustrates interference estimates produced from the results of FIG. 14, using the recursive morphological filter of FIG. 9, according to an embodiment of the present invention.
Figure 16:
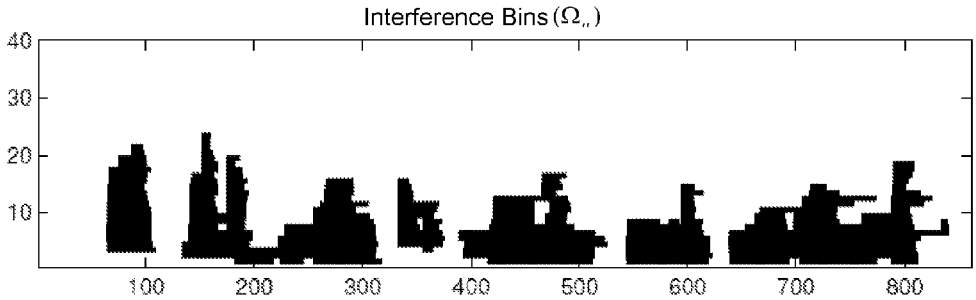
FIG. 16 illustrates interference bins produced while generating the results shown in FIG. 15.

Like equation (6), equation (10) is a linear combination of four terms, the result of which is compared to a threshold. As with equation (6), we have found that $T_{morph}=2$ provides good results. FIG. 14 illustrates onsets $G_{on}(\kappa, \mu)$ after morphological filtering of the temporal derivatives of FIG. 5, using the recursive interference estimation process described above. A comparison of FIG. 14 (recursive morphological filtering) with FIG. 10 (non-recursive morphological filtering) reveals that recursive morphological filtering is often better at identifying onsets. FIG. 15 illustrates interference estimates $\tilde{\Phi}_{ii}(\kappa, \mu)$ produced from the results of FIG. 14, using the recursive morphological filter. FIG. 16 illustrates interference bins $W_i(\kappa, \mu)$ produced while generating the results shown in FIG. 15.

Post-Processing

Recall that interference estimates will be used to attenuate frequencies in the input signal. The goal of the post-processing operation is to modify the interference estimates $\tilde{\Phi}_{ii}(\kappa, \mu)$ calculated thus far, so as to reduce the negative impact the unmodified interference estimates may have on desired speech signals. For example, post-processing may control the amount of impulsive interference reduction that is performed, so as to control the amount of distortion imposed on any speech signal that may be present. Considerations and processes similar to those discussed above, with respect to interference estimation, also apply to post-processing. For example, in an impulsive interference, the amount of energy in a particular frequency band is expected to decrease over time, as discussed above with respect to FIG. 1. However, in speech, the amount of energy in a particular frequency band may very well increase over time, particularly when the speech includes a new pitch frequency, such as at the beginning of an uttered vowel. Thus, we prefer to enforce a decay over time in the amount by which a frequency may be attenuated. Furthermore, wind buffets and some other impulsive interferences exhibit progressively less spectral energy at progressively higher frequencies. This characteristic of impulsive interferences can be exploited in the post-processing operation.

The interference estimates $\tilde{\Phi}_{ii}(\kappa, \mu)$ calculated above may be analyzed to determine a frequency index $\mu_0$, above which the estimated interference energy monotonically decreases with increasing frequency. (This matches the characteristic of wind noise mentioned above.) We call $\mu_0$ a "start bin" for post processing, because some aspect of post processing may alter the interference estimates beginning, with the start bin, to protect speech from being suppressed along with interference. That is, we choose $\mu_0$ such that it maximizes $\tilde{\Phi}_{ii}(\kappa, \mu)$, and for values of $\mu$ greater than $\mu_0$, the interference estimates $\tilde{\Phi}_{ii}(\kappa, \mu)$ monotonically decreases. The amount of the enforced spectral decay is controlled in a manner similar to the temporal decay exhibited by equation (8). We prefer to modify the interference estimates as shown in equation 11.

$$\hat{\Phi}_{ii}(\kappa, \mu) = \begin{cases} \max\left(\min\left(\alpha_f \cdot \hat{\Phi}_{ii}(\kappa, \mu-1), \tilde{\Phi}_{ii}(\kappa, \mu)\right), \Phi_{nn}(\kappa, \mu)\right) \forall\, \mu > \mu_0 \\ \tilde{\Phi}_{ii}(\kappa, \mu) & \text{otherwise} \end{cases} \tag{11}$$

The positive factor $\alpha_f$ controls the amount of the spectral decay. As with equation (8), $\hat{\Phi}_{ii}(\kappa, \mu)$ is kept from dropping below the level of the stationary noise by means of the max $(\cdot)$ operator. Enforcing a spectral decay is helpful in reducing speech distortions, because wind noise tends to drop after its spectral peak. Hence, if a signal includes components in which the energy rises with increasing frequency, these components are likely to be due to speech.

The final interference estimate is produced using an "aggressiveness" factor $\gamma$, as shown in equation 12.

$$\Phi_{ii}(\kappa,\mu)=\gamma\cdot\hat{\Phi}_{ii}(\kappa,\mu)+(1-\gamma)\cdot\Phi_{nn}(\kappa,\mu) \tag{12}$$

Figure 17:
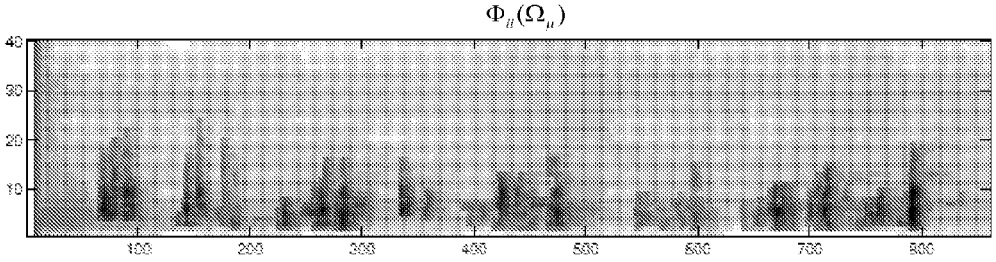
FIG. 17 shows a preliminary interference estimate before post-processing, according to an embodiment of the present invention.
Figure 18:
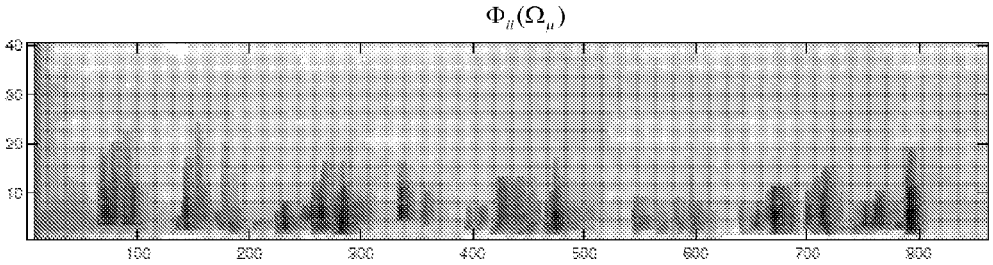
FIG. 18 shows an interference estimate after post-processing, according to an embodiment of the present invention.

This factor introduces a way to control the amount of impulsive interference reduction that is actually performed. FIGS. 17 and 18 illustrate differences obtainable through post-processing the temporal derivatives of FIG. 5. FIG. 17 shows a preliminary interference estimate $\tilde{\Phi}_{ii}(\kappa, \mu)$, and FIG. 18 shows an interference estimate $\Phi_{ii}(\kappa, \mu)$, as modified by post-processing.

Interference Suppression

To suppress the estimated interferences, any suitable noise suppression filter, such as a Wiener filter [8] or classical spectral subtraction [10] [9], may be used, where $\Phi_{ii}(\kappa, \mu)$ is used instead of $\Phi_{nn}(\kappa, \mu)$. An overview of noise suppression techniques is provided in [11]. For a filter with characteristics similar to a Weiner filter, the filter weights should be as shown in equation (13).

$$H_{nr}(\kappa, \mu) = \max\left(1 - \frac{\Phi_{ii}(\kappa, \mu)}{\Phi_{xx}(\kappa, \mu)}, H_{min}\right) \tag{13}$$

$H_{min}$ introduces a limit to the attenuation. This would result in maximum attenuation, which may provide advantages, such being able to cope with musical tones. However, These filter weights may not suppress all audible wind noises. Therefore, we prefer to include another factor to more thoroughly remove the interferences. The factor is chosen, such that the residual noise at the output of the filter exhibits $\Phi_{nn}(\kappa, \mu)\cdot H_{min}^2$ as a PSD. Such a factor is shown in equation (14).

$$H(\kappa, \mu) = H_{nr}(\kappa, \mu) \cdot \sqrt{\frac{\Phi_{nn}(\kappa, \mu)}{\Phi_{ii}(\kappa, \mu)}} \tag{14}$$

The enhanced output spectrum may be obtained through spectral weighting, using equation (15).

$$\hat{S}(\kappa,\mu)=H(\kappa,\mu)\cdot X(\kappa,\mu) \tag{15}$$

A time domain output signal may then be synthesized using overlap add, for instance, or another appropriate method, depending on the respective subband domain processing framework.

Broadband Detection of Impulsive Interferences

To control the post-processing stage, we use broadband information that is available from the morphological interference estimation. A total interference-to-noise ratio (INR) can be used to detect the presence of interferences, and a signal-to-interference ratio (SIR) can be employed to detect speech, even in the presence of interferences.

Figure 19:
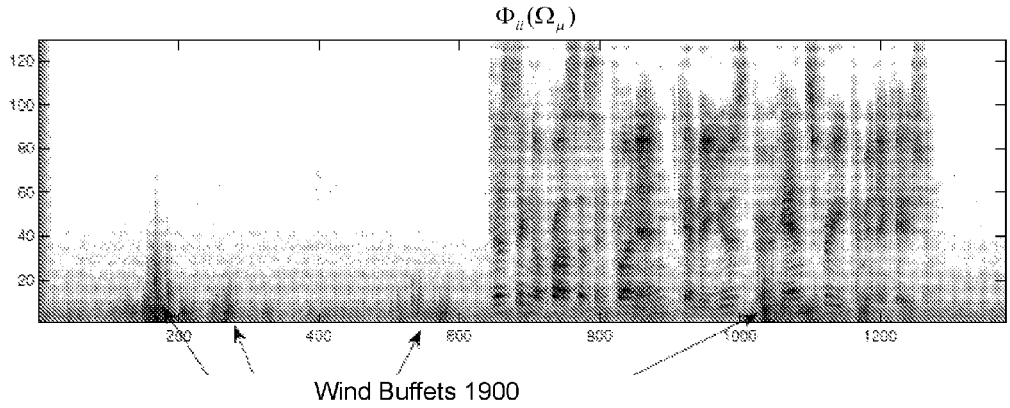
FIG. 19 is an actual spectrogram of a speech signal with occasional wind buffets.
Figure 20:
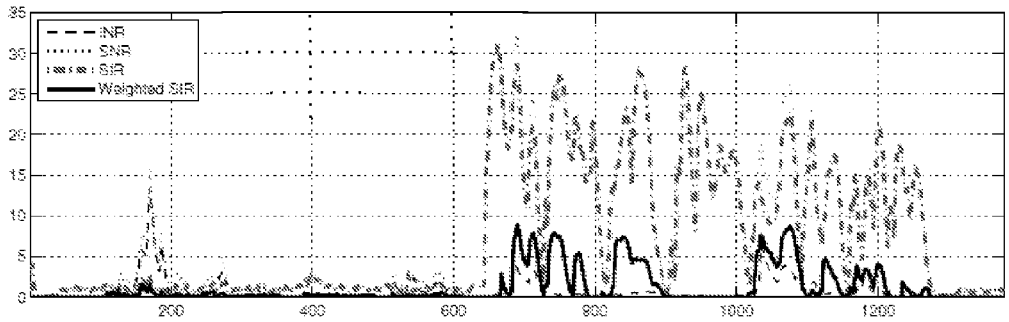
FIG. 20 illustrates various ratios that may be used to detect the presence of interferences and speech for the spectrogram of FIG. 19, according to embodiments of the present invention.

FIG. 19 illustrates an actual spectrogram of a speech signal with occasional wind buffets. FIG. 20 illustrates various ratios that may be used to detect the presence of interferences and speech.

The preliminary estimate of the interference PSD $\tilde{\Phi}_{ii}(\kappa, \mu)$ may be used to compute an estimated total interference-to-noise ratio (INR), according to equation (10).

$$INR(\kappa) = \sum_{\mu=0}^{N-1} 10 \cdot \log_{10}\left(\frac{\tilde{\Phi}_{ii}(\kappa, \mu)}{\Phi_{nn}(\kappa, \mu)}\right) \tag{16}$$

Here, N denotes the number of subbands $\mu$. Optionally, the logarithm and the summation may be exchanged. The estimator $\tilde{\Phi}_{ii}(\kappa, \mu)$ contains some estimation errors. Nevertheless, the sum is suitable to detect the presence of impulsive interferences, as the example in FIGS. 19 and 20 demonstrate. The INR is a good source of information for constructing an interference detector that works on a longer time scale. It may, for instance, be used to compute measures, such as "wind buffets per minute." Furthermore, an average INR taken over the past ten seconds or so could provide a measure of the energy of the interferences.

The presence of interferences, as described above, is important to control the post-processing. It is, however, also important to obtain information about the presence of desired signal components. To this end, we integrate the ratios of the input PSD and the estimated interference PSD to obtain a signal-to-interference ratio, as shown in equation (17).

$$SIR(\kappa) = \sum_{\mu=0}^{N-1} U(\kappa, \mu) \cdot 10 \cdot \log_{10}\left(\frac{\Phi_{xx}(\kappa, \mu)}{\tilde{\Phi}_{ii}(\kappa, \mu)}\right) \tag{17}$$

As discussed above, the logarithm and the summation may be exchanged. The real-valued function $U(\kappa, \mu)$ assigns a weight to each part of the sum. The quantity obtained from equation (17) can be used to detect the presence of a speech signal, independent of the presence of impulsive interferences. In the absence of impulsive interferences, the SIR(κ) turns into a "signal-to-noise ratio" (SNR), because $\tilde{\Phi}_{ii}(\kappa, \mu)$ is then equal to $\Phi_{nn}(\kappa, \mu)$.

$U(\kappa, \mu)$ facilitates emphasizing components that occur in the spectral vicinity of the interferences and are, therefore, more likely to be distorted unless special precautions are taken. In other words, $U(\kappa, \mu)$ can be used to make the proposed measure in equation (17) insensitive to components that are spectrally separated from the estimated interference. In this is case, the post-processing can be controlled to remove the interference, even though there are, for example, desired components in the upper frequencies. Any suitable cost function can be used to derive the weights $U(\mu)$. FIG. 20 illustrates an example of the SIR with and without the weights $U(\mu)$.

Many aspects of the post-processing may be controlled, based on SIR and/or INR. Three such aspects are discussed below. The spectral decay factor $\alpha_f$ provides a means to protect the speech signal, as discussed above. If a fast decay is enforced, speech components above $\mu_0$ are protected by the post-processing. This is typically done on a frame-by-frame basis. Here, the weighted SIR, according to equation (17), can be employed, as this indicates the risk of suppressing the desired signal.

The start bin $\mu_0$, above which the spectral decay in the estimated interference energy is enforced, can be reduced. Reducing the $\mu_0$ bin may be particularly helpful if $\mu_0$ happens to coincide with a bin that includes a pitch frequency. In other words, if, according to the preliminary interference estimate $\tilde{\Phi}_{ii}(\kappa, \mu)$, a start bin $\mu_0$ happens to be determined that includes a speech component, such as a pitch frequency, the corresponding speech energy would be inadvertently considered part of the interference energy, and it will be suppressed. We have found that selecting a lower start bin $\mu_0$ may alleviate or mitigate this problem. Because the determined start bin $\mu_0$ represents a frequency having maximum energy, a lower numbered start bin represents a frequency having less than maximum energy. Thus, using the lower numbered start bin, the roll-off in the interference estimates begins at a lower energy level. Effectively, we remove at least part of the speech energy from the estimated interference energy; therefore we prevent at least part of the speech energy from being suppressed. Selecting a lower numbered start bin may not be appropriate in all cases. For example, a decision whether to select a lower numbered start bin may be based on a weighted SIR, such as when risk of suppressing speech is deemed high.

The aggressiveness factor γ can be controlled to reduce the overall amount of interference suppression. This may mainly be used as a "switch" to turn on the interference suppression if interferences have been detected on a relatively long time scale. For this purpose, measures such as the above mentioned "average INR during the past seconds" are preferably used as a basis. In order to control the aggressiveness, we recommend computing the INR based on $\hat{\Phi}_{ii}(\kappa, \mu)$, rather than on $\tilde{\Phi}_{ii}(\kappa, \mu)$. If this is done, the control of the aggressiveness benefits from the preceding post-processing step (equation (11)).

Figure 21:
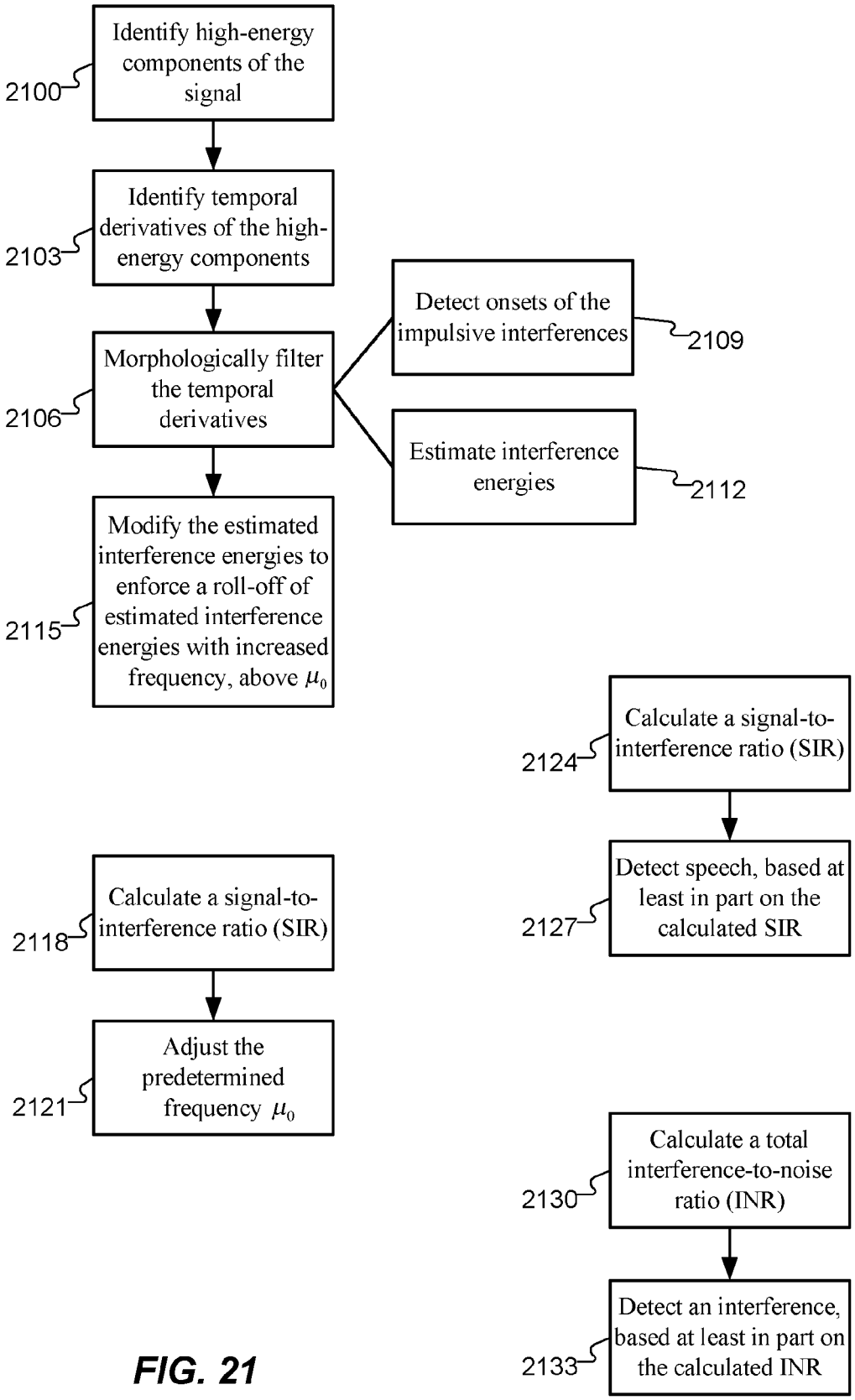
FIG. 21 is a schematic flowchart illustrating operation of some embodiments and alternatives of the present invention.

FIG. 21 is a schematic flowchart illustrating operation of some embodiments and alternatives of the present invention. At 2100, high-energy components of an input signal are identified. At 2103, temporal derivatives of the high-energy components are identified. At 2106, the temporal derivatives are morphologically filtered. The morphological filtering may include detecting onsets of the impulsive interferences at 2109 and estimating interference energies at 2112. At 2115, the estimated interference energies are modified to enforce a roll-off of estimated interference energies with increased frequency above $\mu_0$. Operation 2115 is an example of post-processing.

FIG. 21 also includes schematic flowcharts for optional operations of some embodiments of the present invention. At 2118, a signal-to-interference ratio (SIR) is automatically calculated, and at 2121, the predetermined frequency $\mu_0$ is automatically adjusted, based on the calculated SIR. At 2124, a signal-to-interference ratio (SIR) is automatically calculated, and at 2127, speech is detected, based at least in part on the calculated SIR. At 2130, a total interference-to-noise ratio (INR) is automatically calculated, and at 2133, an interference is detected, based at least in part on the calculated INR.

The methods and apparatus for reducing impulsive interferences in a signal that are described herein may be used to advantage in suppressing wind buffets and other impulsive interferences in automotive speech recognition systems, mobile telephones, military communications equipment and other contexts. Systems and methods according to the disclosed invention provide advantages over the prior art because, for example, these systems and methods do not need to ascertain a pitch frequency in the signal being processed. Furthermore, these systems and methods do not rely on models of wind noise, as Hetherington's proposals do. In addition, no prior art we are aware of involves post-processing or feedback loop processing, as disclosed herein.

The methods and apparatus disclosed herein may also be implemented in hardware, firmware and/or combinations thereof. For example, the components shown in FIGS. 7-9, and the operations described with reference to FIGS. 12, 13, and 21, may be implemented by a processor executing instructions stored in a memory. Methods and apparatus for reducing impulsive interferences have been described as including a processor controlled by instructions stored in a memory. The memory may be random access memory (RAM), read-only memory (ROM), flash memory or any other memory, or combination thereof, suitable for storing control software or other instructions and data. Some of the functions performed by the methods and apparatus have been described with reference to flowcharts and/or block diagrams. Those skilled in the art should readily appreciate that functions, operations, decisions, etc. of all or a portion of each block, or a combination of blocks, of the flowcharts or block diagrams may be implemented as computer program instructions, software, hardware, firmware or combinations thereof. Those skilled in the art should also readily appreciate that instructions or programs defining the functions of the present invention may be delivered to a processor in many forms, including, but not limited to, information permanently stored on non-writable storage media (e.g. read-only memory devices within a computer, such as ROM, or devices readable by a computer I/O attachment, such as CD-ROM or DVD disks), information alterably stored on writable storage media (e.g. floppy disks, removable flash memory, re-writable optical disks and hard drives) or information conveyed to a computer through communication media, including wired or wireless computer networks. In addition, while the invention may be embodied in software, the functions necessary to implement the invention may optionally or alternatively be embodied in part or in whole using firmware and/or hardware components, such as combinatorial logic, Application Specific Integrated Circuits (ASICs), Field-Programmable Gate Arrays (FPGAs) or other hardware or some combination of hardware, software and/or firmware components.

While the invention is described through the above-described exemplary embodiments, it will be understood by those of ordinary skill in the art that modifications to, and variations of, the illustrated embodiments may be made without departing from the inventive concepts disclosed herein. For example, although some aspects of methods and apparatus have been described with reference to flowcharts, those skilled in the art should readily appreciate that functions, operations, decisions, etc. of all or a portion of each block, or a combination of blocks, of any flowchart may be combined, separated into separate operations or performed in other orders. Similarly, although some aspects of methods and apparatus have been described with reference to block diagrams, those skilled in the art should readily appreciate that functions, operations, decisions, etc. of all or a portion of each block, or a combination of blocks, of any block diagram may be combined, separated into separate operations or performed in other orders. Furthermore, disclosed aspects, or portions of these aspects, may be combined in ways not listed above. Accordingly, the invention should not be viewed as being limited to the disclosed embodiments.

BIBLIOGRAPHY

[1] E. Hänsler, G. Schmidt: Acoustic Echo and Noise Control: A Practical Approach. Wiley IEEE Press, New York, N.Y. (USA), 2004.

[2] S. V. Vaseghi and P. J. W. Rayner: A new application of adaptive filters for restoration of archived gramophone recordings, Proc. IEEE International Conference on Acoustics, Speech, and Signal Processing (ICASSP), 1988.

[3] S. J. Godsill and C. H. Tan: Removal of low frequency transient noise from old recordings using model-based signal separation techniques, IEEE ASSP Workshop on Applications of Signal Processing to Audio and Acoustics, 1997.

[4] B. King and L. Atlas: Coherent modulation comb filtering for enhancing speech in wind noise, 11th International Workshop on Acoustic Echo and Noise Control (IWAENC), 2008.

[5] N. Abu-Shikhah and M. Deriche: A robust technique for harmonic analysis of speech, Proc. IEEE International Conference on Acoustics, Speech, and Signal Processing (ICASSP), 2001.

[6] N. Ahmed, T. Natarajan and K. R. Rao: Discrete cosine transform, IEEE Transactions on Computers, Vol. 100, No. 23, 1974.

[7] E. Nemer and W. Leblanc: Single-Microphone wind noise reduction by adaptive post-filtering, IEEE Workshop on Applications of Signal Processing to Audio and Acoustics, 2009.

[8] E. Hänsler: Statistische Signale. Springer Verlag, Berlin (Germany), 2001.

[9] Y. Ephraim, D. Malah: Speech Enhancement Using a Minimum Mean-Square Error Short-Time Spectral Amplitude Estimator. IEEE Transactions On Acoustics, Speech, And Signal Processing, Vol. ASSP-32, No. 6, December 1984.

[10] S. F. Boll: Suppression of Acoustic Noise in Speech Using Spectral Subtraction. IEEE Trans. Acoust. Speech Signal Process, Vol. 27, No. 2, pp: 113-120, 1979.

[11] G. Schmidt: Single-Channel Noise Suppression Based on Spectral Weighting—An Overview. Eurasip Newsletter, Vol. 15, No. 1, pp. 9-24, March 2004.

What is claimed is:

1. A method for reducing impulsive interferences in a noisy speech signal, the method comprising:

receiving the noisy speech signal from a microphone of a device;

identifying, using a computer processor of the device, a plurality of high-energy components of the noisy speech signal, wherein energy of each of the plurality of identified high-energy components exceeds a predetermined threshold;

identifying, using one or more computer processors of the device, a plurality of temporal derivatives for each of the plurality of identified high-energy components, wherein each of the temporal derivatives comprise changes over time in energies of a respective frequency component, wherein each of the plurality of identified temporal derivatives is associated with a respective frequency range, and the frequency ranges associated with the plurality of identified temporal derivatives collectively form a contiguous range of frequencies beginning below a predetermined frequency;

morphologically filtering, using the one or more computer processors of the device, the identified plurality of temporal derivatives, including detecting onsets of the impulsive interferences and estimating a plurality of interference energies in the noisy speech signal, based at least in part on the plurality of identified temporal derivatives, wherein the impulsive interferences correspond to bursts of energy in the noisy speech signal having a substantially random time of occurrence; and suppressing, using the one or more computer processors of the device, portions of the noisy speech signal having the impulsive interferences, based on the plurality of estimated interference energies to generate an enhanced speech signal for automatic speech recognition.

2. A method according to claim 1, wherein identifying the plurality of high-energy components comprises determining the threshold, such that the threshold is below a spectral envelope of the signal.

3. A method according to claim 1, wherein identifying the plurality of high-energy components comprises determining the threshold, based at least in part on a spectral envelope of the signal and at least in part on a power spectral density of stationary noise in the signal.

4. A method according to claim 3, wherein determining the threshold comprises determining the threshold, such that:

under a first condition, the threshold is a calculated value below the spectral envelope of the signal; and under a second condition, the threshold is a calculated value above the power spectral density of the stationary noise.

5. A method according to claim 1, wherein the contiguous range of frequencies is a semi-contiguous range of frequencies comprising at least one gap, wherein each gap of the at least one gap is less than a predetermined size.

6. A method according to claim 1, wherein identifying the plurality of temporal derivatives comprises identifying a region of proximate temporal derivatives in a spectrum of the plurality of identified high-energy components.

7. A method according to claim 1, wherein morphologically filtering the identified plurality of temporal derivatives comprises applying a two-dimensional image filter to the plurality of identified temporal derivatives.

8. A method according to claim 1, wherein estimating the plurality of interference energies comprises initially estimating the interference energies based on a power spectral density of the signal for at least a predetermined period of time and thereafter imposing a temporal monotonic decay on the estimated interference energies.

9. A method according to claim 1, wherein morphologically filtering the identified plurality of temporal derivatives comprises calculating values for a plurality of interference bins, based at least in part on the plurality of estimated interference energies.

10. A method according to claim 9, wherein detecting the onsets of the impulsive interferences comprises detecting the onsets of the impulsive interferences based at least in part on the calculated values for the plurality of interference bins of a previous time frame.

11. A method according to claim 1, further comprising automatically:

determining a starting frequency; and modifying the plurality of estimated interference energies, so as to enforce a progressively smaller estimated interference energy for progressively higher frequencies, beginning at the determined starting frequency.

12. A method according to claim 11, further comprising automatically:

calculating at least one of a signal-to-interference ratio (SIR) and a total interference-to-noise ratio (INR); and based on the calculated at least one of the SIR and the INR, adjusting an operational parameter that influences how the plurality of estimated interference energies are modified.

13. A method according to claim 11, wherein suppressing the portions of the noisy speech signal comprises subtracting the plurality of modified estimated interference energies from the noisy speech signal to generate the enhanced signal.

14. A method according to claim 1, wherein suppressing the portions of the noisy speech signal comprises:

modifying the plurality of estimated interference energies based on external information about a presence the noisy speech signal, wind and/or other signal or interference information; and subtracting the plurality of modified estimated interference energies from the noisy speech signal to generate the enhanced signal.

15. A method according to claim 1, wherein suppressing the portions of the noisy speech signal comprises:

modifying the plurality of estimated interference energies to enforce a roll-off of the plurality of estimated interference energies with increased frequency above a threshold; and subtracting the plurality of modified estimated interference energies from the noisy speech signal to generate the enhanced signal.

16. A method according to claim 1, wherein the impulsive interferences are wind noise.

17. A system, comprising:

a processor and a memory configured to:

receive a noisy speech signal from a microphone of a device;

identify, using the processor, a plurality of high-energy components of the noisy speech signal, wherein energy of each of the plurality of identified high-energy components exceeds a predetermined threshold;

identify a plurality of temporal derivatives of the plurality of identified high-energy components, wherein a temporal derivative comprises changes over time in energies of a frequency component, wherein each of the plurality of identified temporal derivatives is associated with a frequency range, and the frequency ranges associated with the plurality of identified temporal derivatives collectively form a contiguous range of frequencies beginning below a predetermined frequency;

detect onsets of impulsive interferences in the noisy speech signal and estimate a plurality of interference energies in the noisy speech signal, based at least in part on the plurality of identified temporal derivatives, wherein the impulsive interferences correspond to bursts of energy in the noisy speech signal having a substantially random time of occurrence; and suppress portions of the noisy speech signal having the impulsive interferences, based on the plurality of estimated interference energies to generate an enhanced speech signal for automatic speech recognition.

18. A system according to claim 17, wherein the temporal differentiator is configured to identify the plurality of temporal derivatives, such that each of the plurality of identified temporal derivatives exceeds a predetermined value.

19. A non-transitory computer-readable medium having instructions stored thereon for reducing impulsive interferences in a noisy speech signal, such that when the instructions are executed by a processor, the processor performs steps including:

receiving the noisy speech signal from a microphone of a device;

identifying a plurality of high-energy components of the noisy speech signal, wherein energy of each of the plurality of identified high-energy components exceeds a predetermined threshold;

identifying a plurality of temporal derivatives of the plurality of identified high-energy components, wherein a temporal derivative comprises changes over time in energies of a frequency component, wherein each of the plurality of identified temporal derivatives is associated with a frequency range, and the frequency ranges associated with the plurality of identified temporal derivatives collectively form a contiguous range of frequencies beginning below a predetermined frequency;

morphologically filtering the identified plurality of temporal derivatives, including detecting onsets of the impulsive interferences and estimating a plurality of interference energies in the noisy speech signal, based at least in part on the plurality of identified temporal derivatives, wherein the impulsive interferences correspond to bursts of energy in the noisy speech signal having a substantially random time of occurrence; and suppressing portions of the noisy speech signal having the impulsive interferences, based on the plurality of estimated interference energies to generate an enhanced speech signal for automatic speech recognition.

* * * * *